US009914881B2

(12) United States Patent
Towarnicky et al.

(10) Patent No.: US 9,914,881 B2
(45) Date of Patent: Mar. 13, 2018

(54) PROCESS FOR IMPROVED VACUUM SEPARATIONS WITH HIGH VAPORIZATION

(71) Applicant: UOP LLC, Des Plaines, IL (US)

(72) Inventors: Andrew J. Towarnicky, Chicago, IL (US); Grant H. Yokomizo, Mount Prospect, IL (US)

(73) Assignee: UOP LLC, Des Plaines, IL (US)

( * ) Notice: Subject to any disclaimer, the term of this patent is extended or adjusted under 35 U.S.C. 154(b) by 769 days.

(21) Appl. No.: 14/561,139

(22) Filed: Dec. 4, 2014

(65) Prior Publication Data

US 2016/0160135 A1 Jun. 9, 2016

(51) Int. Cl.
*C10G 7/06* (2006.01)
*C10G 53/02* (2006.01)

(52) U.S. Cl.
CPC ..... *C10G 7/06* (2013.01); *C10G 53/02* (2013.01)

(58) Field of Classification Search
CPC . C10G 53/02; C10G 7/06; C10G 7/00; C10G 31/00; C10G 31/06; B01D 3/06; B01D 3/10
See application file for complete search history.

(56) References Cited

U.S. PATENT DOCUMENTS 4,321,132 A 3/1982 Richards
4,797,197 A 1/1989 Mallari
4,795,551 A 3/1989 Hamilton et al.
6,632,351 B1 10/2003 Ngan et al.
7,226,533 B2 6/2007 Angulo Aramburu
7,906,010 B2 3/2011 Keusenkothen et al.
8,070,938 B2 12/2011 Stein et al.
8,083,932 B2 12/2011 Baumgartner et al.
8,105,479 B2 1/2012 Ou et al.
2014/0027347 A1 1/2014 Hoehn et al.
2014/0374322 A1 12/2014 Venkatesh

FOREIGN PATENT DOCUMENTS

CN 102311772 B 4/2014
EP 2174697 A1 4/2010
WO 2013107738 A1 7/2013

OTHER PUBLICATIONS

Search Report dated Apr. 14, 2016 for corresponding PCT Application No. PCT/US2015/062936.

*Primary Examiner* — Renee Robinson
*Assistant Examiner* — Derek N Mueller

(57) ABSTRACT

Methods and apparatus for vacuum separation are described. The method includes heating a feed comprising a mixture of light and heavy hydrocarbons in a first heating zone. The heated feed is flashed in a flash drum to form a liquid stream and a vapor stream. The liquid stream is heated in a second heating zone. The heated liquid stream is introduced into a vacuum distillation column through a first inlet. The vapor stream from the flash drum is introduced into the vacuum distillation column through a second inlet located above the first inlet, the vapor stream of the flash drum being in fluid communication with the vacuum distillation column.

18 Claims, 3 Drawing Sheets

PROCESS FOR IMPROVED VACUUM SEPARATIONS WITH HIGH VAPORIZATION

BACKGROUND OF THE INVENTION

In refinery operations such as a vacuum distillation unit and similar services, the degree of vacuum separation attainable may be limited by various factors and concerns. One concern is for excessive coking of the vacuum column charge heater. To avoid excessive coking, limits may be placed on the system, such as a limit on the outlet temperature of the charge heater, or a limit of a specified degree of vaporization at the heater outlet. Limiting the outlet temperature of the charge heater relates to the time-at-temperature that the liquid film on the process side of the heater tubes experiences, with higher time-at-temperature being correlated to increased coking/fouling. The liquid film temperature can be significantly hotter than the bulk process temperature. Limiting the degree of vaporization at the heater outlet relates to the propensity for a dry-point to form inside heater tubes, wherein the liquid film vaporizes and comes to an end. As the liquid film shrinks and ceases to exist, both its temperature and the heat flux through it increase until it exits the charge heater, vaporizes, or cokes on the heater tubes. Such limits on the vacuum column charge heater outlet temperature or degree of vaporization can negatively impact the amount of lift attainable in the vacuum unit.

In other services, the process may be even more sensitive to such limits. For example if a process involves separation of a mixture of 80 wt % light hydrocarbons and 20 wt % heavy hydrocarbons, the processing may be severely restricted by a vaporization limit. If the heavy hydrocarbons are very heavy, such as streams containing a significant amount of heavy poly-aromatics, the charge heater outlet temperature might also be limited to avoid exposing these components to excessive time-at-temperature.

Furthermore, in existing processes, the feed to a vacuum distillation unit has typically already been through distillation at atmospheric pressure in a refinery's crude distillation unit (CDU). As a result, simple inclusion of a flash drum upstream or downstream of the vacuum column charge heater would not be justified. Flash drums are usually included in a design to remove non-condensables or components substantially above their critical points as to be clearly located in the vapor phase. The amount of such components present following atmospheric distillation is insufficient to justify inclusion of the flash drum and associated equipment downstream of the vacuum column charge heater. In addition, the inclusion of a flash drum downstream of the vacuum column charge heater would have other negative effects including the loss of vapor traffic to the column and material that would act in a stripping service, decreased resolution of product separation, and the requirement of a higher heater outlet temperature, which is undesirable with regard to feed cracking and coking, and the same limits described previously. The disadvantages of such configurations apply whether or not the flash drum is coupled to the vapor space in the vacuum column or to the vacuum column overhead.

Therefore, there is a need for improved vacuum separation processes with high vaporization.

SUMMARY OF THE INVENTION

One aspect of the invention is a method of vacuum separation. In one embodiment, the method includes heating a feed comprising a mixture of light hydrocarbons and heavy hydrocarbons in a first heating zone. The heated feed is flashed in a flash drum to form a liquid stream and a vapor stream. The liquid stream is heated in a second heating zone. The heated liquid stream is introduced into a vacuum distillation column through a first inlet. The vapor stream from the flash drum is introduced into the vacuum distillation column through a second inlet located above the first inlet, the vapor stream of the flash drum being in fluid communication with the vacuum distillation column.

Another aspect of the invention is a vacuum distillation apparatus. In one embodiment, the apparatus includes a feed line; a first heating zone in thermal communication with the feed line, the first heating zone having an inlet and an outlet; a flash drum having an inlet, a liquid outlet, and a vapor outlet, the inlet of the flash drum in fluid communication with the feed line and located downstream of the outlet of the first heating zone; a second heating zone in thermal communication with the liquid outlet of the flash drum, the second heating zone having an inlet and an outlet; and a vacuum distillation column located downstream of the outlet of the second heating zone, the vacuum distillation column having at least two inlets and an outlet, the first inlet of the vacuum distillation column being in fluid communication with the liquid outlet of the flash drum, the second inlet of the vacuum distillation column being in fluid communication with the vapor outlet of the flash drum, the second inlet located above the first inlet.

DETAILED DESCRIPTION OF THE INVENTION

Figure 1:
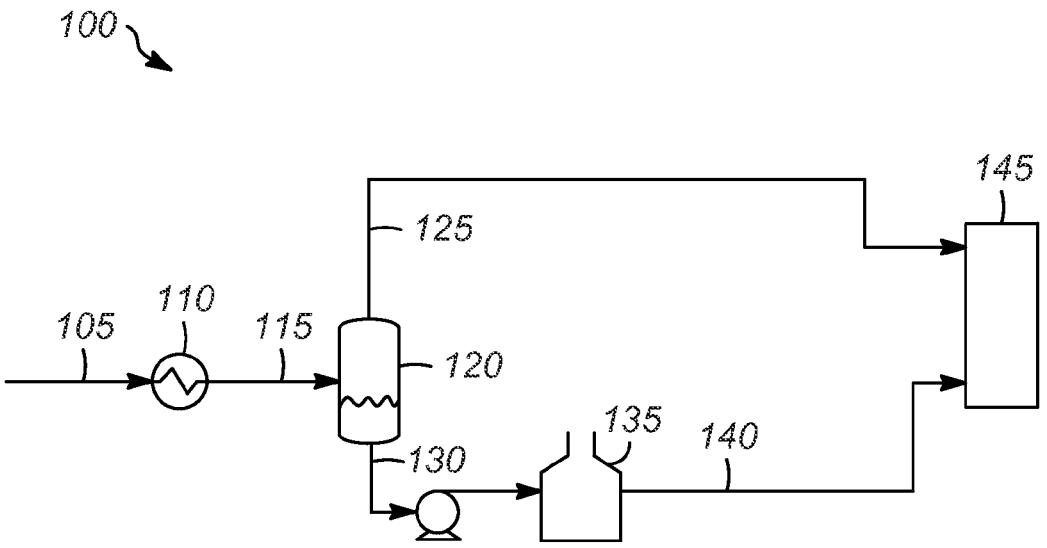
FIG. 1 illustrates one embodiment of a process of the present invention

The present invention overcomes these problems by utilizing low pressure flash drums in novel configurations. The flash drum is located between two heating zones. In some embodiments, the heating zones are separate heaters, while in other embodiments, the heating zones are the radiant and convection heating zones of a single heater.

The liquid stream from the flash drum is heated in the second heating zone and sent to the vacuum distillation column. The section of the vacuum distillation column receiving this heated liquid is generally known as the column flash zone.

The vapor stream from the flash drum is also sent to the vacuum distillation column. The vapor space of the flash drum is in fluid communication with the vacuum distillation column. The vapor stream enters the vacuum distillation column above where the liquid stream enters, typically in the top ½ of the column, depending on the heat integration of the total system. The vapor stream can be sent directly to the vacuum distillation column, or it can be cooled and flashed a second time, with the second vapor stream being sent to the vacuum distillation zone. The second liquid stream can be recovered and/or recycled. Condensing the flash vapor stream reduces the load on the column.

The processes can be used to recover solvent from a mixture with heavy hydrocarbons.

The processes achieve greater lift with significantly less equipment than is otherwise required, e.g., two vacuum columns. The processes also provide an additional degree of design freedom, the flash temperature, for the process. The added design freedom is particularly useful in solvent recovery from mixtures containing heavy hydrocarbons, such as de-ashing processes for pitch.

One specific example where both the limitation on the outlet temperature and the limitation on the vaporization at the heater outlet might be encountered is in a process for de-ashing thermally hydrocracked un-converted oil, or pitch. One such de-ashing process is described in U.S. application Ser. No 14/534,729, entitled PROCESSES FOR PRODUCING DEASHED PITCH, filed Nov 6, 2014, which is incorporated herein by reference. The de-ashing process involves mixing pitch with fluid catalytic cracking (FCC) light cycle oil (LCO) or another suitable solvent, a series of mechanical separations to remove the pitch ash content, and then a separation of the LCO (or other solvent) from the pitch using vacuum distillation to effect solvent recovery. The pitch is a very heavy hydrocarbon, and it is necessary to limit its time-at-temperature, in this case to a charge heater outlet temperature of about 385° C. (725° F.). The proportions of LCO (or other solvent) and pitch may vary, and it could be up to about 85 wt % LCO and 15wt % pitch. Part of the pitch is also volatile, so in some cases a vaporization above 90wt % may be desirable to achieve fractionation. In this instance, in an embodiment with 68 wt % (84 vol %) vaporization, if a dry-point design limit is set at 75 vol % vaporization, then the attainable lift in the vacuum column would be considerably decreased. Due to such limitations, using a conventional approach, two or more columns and charge heaters (or other heat sources) in series may be needed to achieve the desired lift. However, by using the process of the present invention, a single vacuum distillation column can be used.

In the first process, the flash drum vapor is routed directly to the vapor space in the vacuum column. The preferred receiving vapor space location of the vacuum column would depend on the temperature of the flash drum vapor, for the purposes of efficient heat integration. Typically, this may be in the upper ½ of the column. Since this would result in either a larger vacuum column or an overhead vacuum producing section, it may be a non-ideal arrangement. However, this configuration may be useful in traditional vacuum operations by conducting a flash in between a charge heater's convection and radiant zones. This may allow the radiant zone to be operated at higher temperature.

The first process 100 is illustrated in FIG. 1. The feed 105, which contains the mixture of light hydrocarbons and/or solvent and heavy hydrocarbons, e.g., reduced crude, or, e.g., vacuum gas oil (VGO) or LCO, and pitch, is introduced into a first heating zone 110.

The light hydrocarbons and/or solvent include, but are not limited to, VGO (including light and heavy), LCO, the light portions of a reduced crude stream, reformate, toluene, mixed xylenes, furfural, Hi-Sol 15 (available from Jamson Laboratories, Inc., and combinations thereof.

The heavy hydrocarbons include, but are not limited to, thermally hydrocracked pitch, coal tar pitch, de-asphalting unit pitch, and the heavy portions of a reduced crude stream, and the like.

The first heating zone 110 can be any suitable heating zone, including, but not limited to, a heat exchanger, a fired heater, the convection zone of a fired heater, a steam heater, a hot oil heater, an electric heater, or combinations thereof.

The incoming feed 105 will depend on its source. It can be at any suitable temperature. For example, depending upon a process unit's heat exchanger network, it may usually be at a temperature of about 204° C. (400° F.) to about 316° C. (600° F.), e.g., about 260° C. (500° F.). The feed 105 is heated to a temperature of about 260° C. (500° F.) to about 371° C. (700° F.), or about 316° C. (600° F.) to about 343° C. (650° F.), e.g., about 343° C. (650° F.) in the first heating zone 110.

The heated feed 115 is sent to a flash drum 120 where it is flashed into a vapor stream 125 containing primarily the light hydrocarbons, e.g., VGO and optional solvent (if any), and a liquid stream 130 containing primarily the heavy hydrocarbons, e.g., the pitch.

The liquid stream 130 is sent to the second heating zone 135. The second heating zone 135 can be any suitable heating zone, including, but not limited to, fired heaters, the radiant zone of a fired heater, electric heaters, and the like. The second heating zone 135 heats the liquid stream 130 to about 371° C. (700° F.) to about 482° C. (900° F.), or about 385° C. (725° F.) to about 482° C. (900° F.), or about 427° C. (800° F.) to about 482° C. (900° F.), or about 385° C. (725° F.) to about 454° C. (850° F.).

The heated liquid stream 140 is sent to vacuum distillation column 145 for separation.

The vapor stream 125 is sent directly to the vacuum distillation column 145. The vapor stream 125 preferably enters the vacuum distillation column 145 at a point higher than the heated liquid stream 140, likely in the middle half of the column, dependent on the heat integration. The vapor stream 125 may be at a pressure of about 100 kPa (gauge) or less, or more typically it may be at vacuum pressure, i.e. 101.325 kPa (absolute) or less, or about 10 kPa(a) or less.

The heated liquid stream 140 and the vapor stream 125 are separated in the vacuum distillation column 145 into product streams which could include, but are not limited to, a light overhead cut, one or more cuts from the various light hydrocarbons and/or solvent, and pitch.

In the second process, the vapor stream from the flash drum is cooled and flashed before being sent to the vacuum distillation column.

Figure 2:
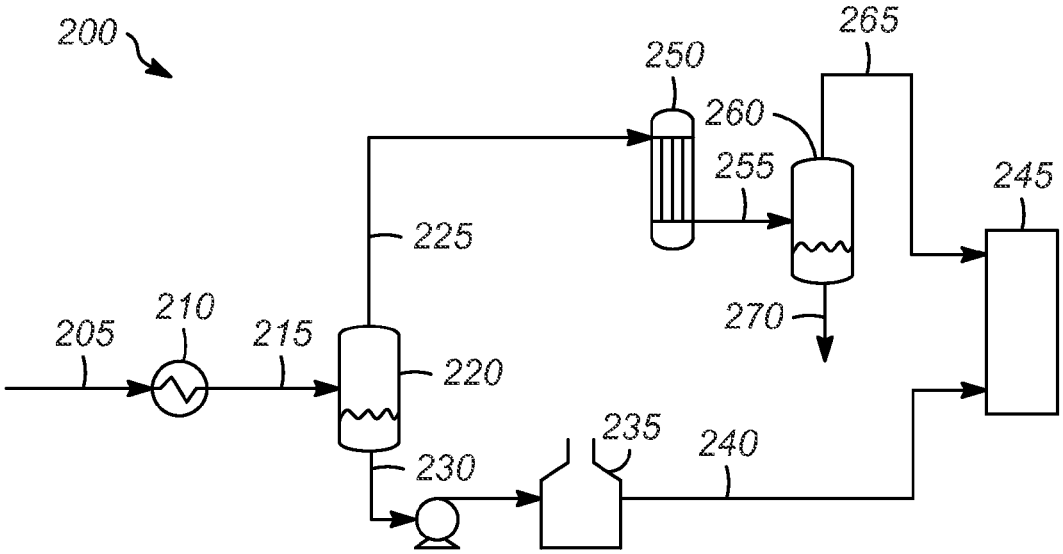
FIG. 2 illustrates another embodiment of a process of the present invention

In the process 200 shown in FIG. 2, the feed 205, which contains the mixture of light hydrocarbons and heavy hydrocarbons as described above, is introduced into a first heating zone 210.

The first heating zone 210 can be any suitable heating zone, such as those described above.

The feed 205 is heated from a temperature of from 204° C. (400° F.) to about 316° C. (600° F.), e.g., about 260° C. (500° F.), to a temperature of 260° C. (500° F.) to about 371° C. (700° F.), or about 316° C. (600° F.) to about 343° C. (650° F.) in the first heating zone 210.

The heated feed 215 is sent to a flash drum 220 where it is flashed into a vapor stream 225 containing primarily the light hydrocarbons, and a liquid stream 230 containing primarily the heavy hydrocarbons.

The liquid stream 230 is sent to the second heating zone 235. The second heating zone 235 can be any suitable heating zone, such as those described above. The second heating zone 235 heats the liquid stream 230 to a temperature of to about 371° C. (700° F.) to about 482° C. (900° F.), or about 385° C. (725° F.) to about 482° C. (900° F.), or about 427° C. (800° F.) to about 482° C. (900° F.), or about 385° C. (725° F.) to about 454° C. (850° F.), e.g., about 385° C. (725° F.).

The heated liquid stream 240 is sent to vacuum distillation column 245 for separation, as described above.

The vapor stream 225 is sent to a heat exchanger 250 where the temperature of vapor stream 225 is reduced from about 260° C. (500° F.) to about 371° C. (700° F.), or about 316° C. (600° F.) to about 343° C. (650° F.) to a temperature of about 204° C. (400° F.) or less, for example. The vapor stream 225 may be at a pressure of about 100 kPa (g) or less, or it may be at vacuum pressure, i.e. about 100 kPa (a) or less, or in some cases preferably about 30 kPa(a) or less.

The cooled vapor stream 255 is sent to a second flash drum 260 where it is separated into a second vapor stream 265 and a second liquid stream 270. The second vapor stream 265 is sent to the vacuum distillation column 245. The second vapor stream 265 preferably enters the vacuum distillation column 245 at a point higher than the heated liquid stream 240. The receiving vapor space location of vacuum distillation column 245 would depend on the temperature of the second vapor stream 265, but may be immediately below the top section of the column, contemplating appropriate heat recovery in heat exchanger 250.

The second liquid stream 270, which is primarily solvent or other light hydrocarbons, can be recovered and/or recycled.

In another embodiment of the process, the flash drum is located between the convection and radiant sections of a single fired heater and is tied to the vacuum column upper sections or overhead. This effects the lift of a large portion of the solvent and some of the volatile pitch. Thus the degree of vaporization in the radiant section of the fired heater is reduced. The shift in composition of the heavy feed to the vacuum column, e.g., that which is heated in the fired heater radiant section, also increases the lift of heavy material at constant heater outlet temperature. In addition, in some embodiments, the solvent lifted in the flash drum is of sufficient purity to be recycled to the process. The condensation of the solvent is a source of high value heat. After condensation only a small amount of vapor is routed to the vapor space of the vacuum distillation column, so that the vacuum distillation column and the associated equipment can also be smaller.

Figure 3:
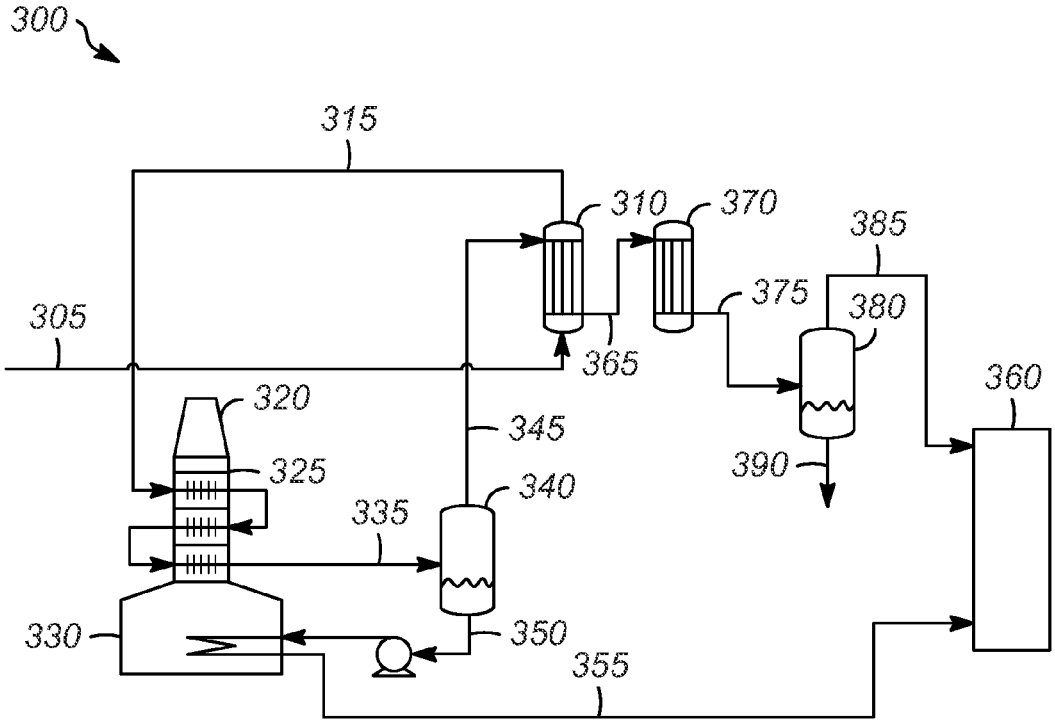
FIG. 3 illustrates another embodiment of a process of the present invention

FIG. 3 illustrates this process 300. The feed 305, which contains the mixture of light hydrocarbons and heavy hydrocarbons described above, is sent to a heat exchanger 310 where the temperature is raised from about of about 204° C. (400° F.) to about 316° C. (600° F.), e.g., about 260° C. (500° F.), to a temperature of about 260° C. (500° F.) to about 371° C. (700° F.), or about 299° C. (570° F.) to about 343° C. (650° F.), or about 299° C. (570° F.) to about 327° C. (620° F.).

The heated feed 315 is sent to a heating zone 320, such as a fired heater, which includes a convection heating zone 325 and a radiant heating zone 330. The heated feed 315 enters the convection heating zone 325 where it is heated to a temperature of about 316° C. (600° F.) to about 427° C. (800° F.), or about 316° C. (600° F.) to about 371° C. (700° F.), or about 316° C. (600° F.) to about 343° C. (650° F.).

The heated feed 335 is sent to flash drum 340 where it is flashed into a vapor stream 345 and a liquid stream 350.

Liquid stream 350 is then sent to radiant heating zone 330 where it is heated to a temperature in the range of about 371° C. (700° F.) to about 482° C. (900° F.), or about 385° C. (725° F.) to about 482° C. (900° F.), or about 427° C. (800° F.) to about 482° C. (900° F.), or about 385° C. (725° F.) to about 454° C. (850° F.)., e.g., about 385° C. (725° F.).

The heated liquid stream 355 is sent to vacuum distillation column 360 for separation, as described above.

The vapor stream 345, which is at a temperature of about 260° C. (500° F.) to about 427° C. (800° F.), or about 316° C. (600° F.) to about 343° C. (650° F.), is sent to heat exchanger 310 where the temperature of vapor stream 345 is reduced in an aspect by heat exchange with feed 305. The cooled vapor 365 is sent to a second heat exchanger 370 for further temperature reduction to a temperature of about 204° C. (400° F.) or less, for example. The vapor stream 345 may be at a pressure of about 100 kPa (g) or less, or it may be at vacuum pressure, i.e. about 100 kPa (a) or less, or preferably about 50 kPa(a) or less.

The cooled vapor stream 375 is sent to a second flash drum 380 where it is separated into a second vapor stream 385 and a second liquid stream 390. The second vapor stream 385 is sent to the vacuum distillation column 360. Stream 385 will typically join the vapor space of the vacuum distillation column 360 either just below the top fractionation section or at the overhead vapor outlet, depending on the degree of condensation achieved in heat exchanger 370. Preferably, a high degree of condensation is achieved in heat exchanger 370 and the second vapor stream 385 enters the vacuum distillation column 360 at a point higher than the heated liquid stream 355.

The second liquid stream 390, which is primarily solvent and/or light hydrocarbons, can be recycled or recovered as product.

The next embodiment is similar; however, the balance of heat available in the vacuum column charge heater convection and radiant zones require the inclusion of another heater to achieve the desired flash temperature. The additional heater is located upstream of the fired heater convection zone. The heater can be a process exchanger, another fired heater, a hot oil heater, or any other suitable heat source.

Figure 4:
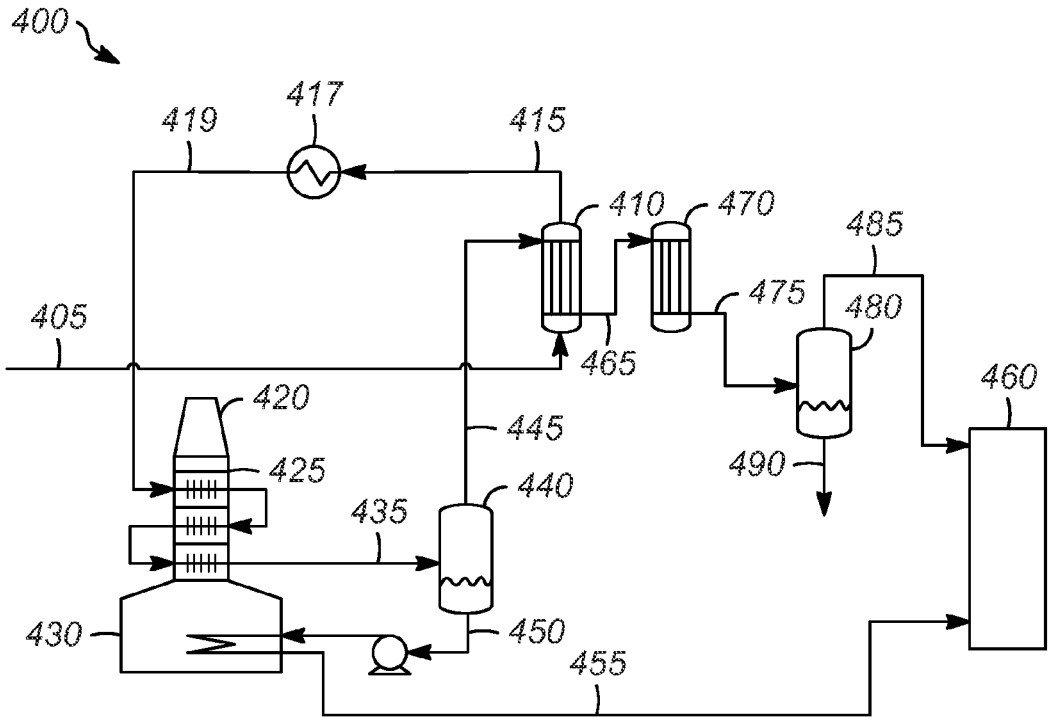
FIG. 4 illustrates still another embodiment of a process of the present invention

FIG. 4 illustrates this process 400. The feed 405, which contains the mixture of light hydrocarbons and heavy hydrocarbons described above, is sent to a heat exchanger 410 where the temperature is raised from about e.g., about 260° C. (500° F.), to a temperature of e.g., about 316° C. (600° F.).

The heated feed 415 is sent to a hot oil heater 417 where it is heated to a temperature of e.g., about 327° C. (620° F.).

The heated feed 419 is sent to a heating zone 420, such as a fired heater, which includes a convection heating zone 425 and a radiant heating zone 430. The heated feed 415 enters the convection heating zone 425 where it is heated to a temperature of e.g., about 343° C. (650° F.).

The heated feed 435 is sent to flash drum 440 where it is flashed into a vapor stream 445 and a liquid stream 450.

Liquid stream 450 is then sent to radiant heating zone 430 where it is heated to a temperature in the range of e.g., about 385° C. (725° F.).

The heated liquid stream 455 is sent to vacuum distillation column 460 for separation, as described above.

The vapor stream 445, which is at a temperature of e.g., about 343° C. (650° F.), is sent to heat exchanger 410 where the temperature of vapor stream 445 is reduced in an aspect by heat exchange with feed 405. The cooled vapor 465 is sent to a second heat exchanger 470 for further temperature reduction to a temperature of about 204° C. (400° F.) or less, for example. The vapor stream 445 may be at a pressure of about 100 kPa (g) or less, or it may be at vacuum pressure, i.e. about 100 kPa (a) or less, or preferably about 50 kPa(a) or less.

The cooled vapor stream 475 is sent to a second flash drum 480 where it is flashed into a second vapor stream 485 and a second liquid stream 490. The second vapor stream 485 is sent to the vacuum distillation column 460. Preferably stream 485 will have a very small flow during normal operation and will typically join the vapor space of the vacuum distillation column 460 either just below the top fractionation section or at the overhead vapor outlet, depending on the degree of condensation achieved in heat exchanger 470. Preferably, the second vapor stream 485 enters the vacuum distillation column 460 at a point higher than the heated liquid stream 455.

The second liquid stream 490, which is primarily solvent and/or light hydrocarbons, can be recycled or recovered as product.

For the processes illustrated in FIGS. 3-4, process simulations using a de-ashing process demonstrated that the process of the invention provided significant improvements over the prior art process, including, among others, a smaller vacuum distillation column, decreased vacuum column fired heater duty, decreases in other associated utilities, and improved HVGO recovery from the pitch. The processes illustrated in FIGS. 3-4 also avoid cracking/coking problems associated with higher degrees of vaporization or higher fired heater outlet temperature.

By "about" we mean within 10% of the value, or within 5%, or within 1%.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A method of vacuum separation comprising;

heating a feed comprising a mixture of light hydrocarbons and heavy hydrocarbons in a first heating zone;

flashing the heated feed in a first flash drum to form a first liquid stream and a first vapor stream;

heating the first liquid stream in a second heating zone;

introducing the heated liquid stream into a vacuum distillation column through a first inlet;

flashing the first vapor stream in a second flash drum to form a second vapor stream and a second liquid stream; and introducing the second vapor stream from the second flash drum into the vacuum distillation column through a second inlet located above the first inlet, the vapor stream of the second flash drum being in fluid communication with the vacuum distillation column.

2. The method of claim 1 wherein a pressure of the first vapor stream from the first flash drum is about 100 kPa(g) or less.

3. The method of claim 1 wherein a temperature of the heated feed is in a range of about 260° C. (500° F.) to about 371° C. (700° F.).

4. The method of claim 1 wherein a temperature of the heated first liquid stream is in a range of about 371° C. (700° F.) to about 482° C. (900° F.).

5. The method of claim 1 wherein a temperature of the feed is in a range of about 204° C. (400° F.) to about 316° C. (600° F.).

6. The method of claim 1 wherein the first heating zone and the second heating zone are separate heaters.

7. The method of claim 1 wherein the first heating zone and the second heating zone are in a single heater, and wherein the first heating zone is a convection heating zone, and wherein the second heating zone is a radiant heating zone.

8. The method of claim 1 further comprising reducing a temperature of the first vapor stream from the flash drum in at least one heat exchanger; wherein the temperature of the reduced temperature first vapor stream is about 204 ° C. (400° F.) or less.

9. The method of claim 8 wherein reducing the temperature of the first vapor stream from the first flash drum in the at least one heat exchanger comprises reducing the temperature of the first vapor stream from the first flash drum in the at least one heat exchanger to a temperature at which about 90% or more of the vapor stream is condensed.

10. The method of claim 1 further comprising:

pre-heating the feed in the at least one heat exchanger before heating the feed in the first heating zone.

11. The method of claim 10 wherein a temperature of the pre-heated feed is in a range of 260° C. (500° F.) to about 343° C. (650° F.).

12. The method of claim 10 further comprising:

heating the pre-heated feed in a pre-heater before heating the feed in the first heating zone.

13. The method of claim 12 wherein a temperature of the pre-heated feed is in a range of 260° C. (500° F.) to about 329° C. (625° F.) and wherein a temperature of the heated pre-heated feed is in a range of 302° C. (575° F.) to about 371° C. (700° F.).

14. A method of vacuum separation comprising;

heating a feed comprising a mixture of light hydrocarbons and heavy hydrocarbons in a first heating zone;

flashing the heated feed in a flash drum to form a liquid stream and a vapor stream;

heating the liquid stream in a second heating zone;

introducing the heated liquid stream into a vacuum distillation column through a first inlet;

reducing a temperature of the vapor stream from the flash drum in at least one heat exchanger;

flashing the reduced temperature vapor stream in a second flash drum to form a second vapor stream and a second liquid stream; and introducing the second vapor stream into the vacuum distillation column through a second inlet located above the first inlet, the vapor stream of the flash drum being in fluid communication with the second flash drum and the vacuum distillation column.

15. A vacuum distillation apparatus comprising:

a feed line;

a first heating zone in thermal communication with the feed line, the first heating zone having an inlet and an outlet;

a first flash drum having an inlet, a first liquid outlet, and a first vapor outlet, the inlet of the first flash drum in fluid communication with the feed line and located downstream of the outlet of the first heating zone;

a second heating zone in thermal communication with the first liquid outlet of the first flash drum, the second heating zone having an inlet and an outlet;

a second flash drum having an inlet, a second liquid outlet, and a second vapor outlet, the inlet of the second flash drum in fluid communication with the first vapor outlet; and a vacuum distillation column located downstream of the outlet of the second heating zone, the vacuum distillation column having at least two inlets and an outlet, the first inlet of the vacuum distillation column being in fluid communication with the first liquid outlet of the first flash drum, the second inlet of the vacuum distillation column being in fluid communication with the second vapor outlet of the second flash drum, the second inlet located above the first inlet.

16. The apparatus of claim 15 further comprising:

a heat exchanger in thermal communication with at least one of the first vapor outlet of the first flash drum and the feed line.

17. The apparatus of claim 16 further comprising:

a heater in thermal communication with the feed line and located between the heat exchanger and the first heating zone.

18. The apparatus of claim 15 wherein the first heating zone comprises a convection zone of a charge heater and the second heating zone comprises the radiant zone of the charge heater.

* * * * *